US007137517B2

(12) United States Patent
Lowry et al.

(10) Patent No.: US 7,137,517 B2
(45) **Date of Patent: *Nov. 21, 2006**

(54) POST IN POST PRODUCT PACKAGING AND DISPLAY STRUCTURE TRAY SYSTEM

(75) Inventors: James W. Lowry, Franklin, TN (US); Steven C. Gendreau, Franklin, TN (US); Lawrence E. Renck, Hartsville, SC (US)

(73) Assignee: Sonoco Development Inc., Hartsville, SC (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/905,747

(22) Filed: Jan. 19, 2005

(65) Prior Publication Data

US 2006/0157380 A1 Jul. 20, 2006

(51) Int. Cl.
*A47B 47/00* (2006.01)
*B65D 85/30* (2006.01)
*B65D 5/42* (2006.01)

(52) U.S. Cl. ..... 211/188; 206/586; 206/600; 211/126.12; 211/194; 229/199

(58) Field of Classification Search ..... 206/386, 206/453, 586, 591, 594, 597, 600; 229/199, 229/918; 108/53.5; 211/135, 182, 186, 211/194, 126.12, 187–188, 191; 220/8
See application file for complete search history.

(56) References Cited

U.S. PATENT DOCUMENTS 2,070,231 A * 2/1937 Katona ..... 220/8
2,349,385 A * 5/1944 Snelling ..... 211/126.12
3,072,313 A * 1/1963 Svendsen ..... 206/586
3,709,163 A * 1/1973 Smedley et al. ..... 108/53.5
3,955,681 A * 5/1976 DeZinno ..... 211/85.1
4,248,350 A * 2/1981 Gilbert ..... 206/586
4,673,092 A * 6/1987 Lamson et al. ..... 108/53.5
5,471,809 A 12/1995 Frankel
5,676,263 A * 10/1997 Chang ..... 211/187
6,378,764 B1 4/2002 Casanovas
6,467,756 B1 10/2002 Elsasser
6,513,662 B1 * 2/2003 Stebelton ..... 206/586
6,550,216 B1 4/2003 Ohanesian
6,796,565 B1 * 9/2004 Choi et al. ..... 211/194
7,066,342 B1 * 6/2006 Baechle et al. ..... 211/191
2003/0111383 A1 * 6/2003 Qiu et al. ..... 206/586
2005/0092637 A1 * 5/2005 Baechle et al. ..... 206/386

FOREIGN PATENT DOCUMENTS

JP 11059733 3/1999

* cited by examiner

*Primary Examiner*—Bryon P. Gehman
(74) *Attorney, Agent, or Firm*—Clausen Miller, P.C.

(57) ABSTRACT

A post in post structure comprising a short inner post segment and a pair of hollow outer posts slipped over either end of the inner post segment and affixed to the inner post segment. The post in post structure is particularly suitable for use with a product packaging and display system of the kind having vertically spaced trays supported by outer posts located over openings in each tray and inner posts inserted inside the outer support posts and through the tray openings to lock the system together.

7 Claims, 5 Drawing Sheets

POST IN POST PRODUCT PACKAGING AND DISPLAY STRUCTURE TRAY SYSTEM

FIELD OF THE INVENTION

This patent relates to the packaging arts. More particularly, this patent relates to a post in post type packaging and display system wherein outer posts are attached to each other by short inner post segments.

DESCRIPTION OF THE RELATED ART

Retailers such as mass merchandisers sometimes display their products in the same packaging that the products were shipped in from the vendors. One form of such packaging comprises vertically arranged trays held apart by support posts.

Sonoco Development, Inc., the assignee of the present invention, has developed a proprietary post in post system for the packaging, shipping and displaying of products in a mass merchandising or general retail environment. The system, described in co-pending U.S. patent application Ser. No. 10/605,814, comprises a plurality of vertically spaced corrugated trays for holding the products, tubular outer support posts that support the trays and space them apart, and inner guide posts that key inside the support posts (thus "post in post") to lock the system together and provide axial compression strength. The tray and post structure may be carried on a standard pallet and wrapped in an outer wrap to protect the products from dust and damage during shipment.

Each corrugated tray has die-cut openings large enough to accommodate the inner guide posts but smaller than the outer support posts. To assemble the system, the inner guide posts may be inserted through the tray openings and the outer support posts slipped over the inner guide posts. The outer support posts evenly space apart the trays and provide a platform for the tray above.

In the original design, the sum of the lengths of the inner guide posts is substantially the same as the sum of the lengths of the outer support posts. In other words, both the inner guide posts and outer support posts extend substantially the entire height of the system, providing a double post support frame. This configuration can be an unnecessary use of post material if the outer support posts themselves are strong enough to support the system.

It is therefore an object of the present invention to provide a post in post packaging and display system in which the inner guide posts are substantially shorter then the outer guide posts.

Another object of the invention is to provide a post in post packaging and display system in which the inner guide posts are attached to the insides of the outer guide posts.

Further and additional objects will appear from the description, accompanying drawings, and appended claims.

SUMMARY OF THE INVENTION

The present invention is a post in post structure for shipping products and displaying them in a retail environment. The structure comprises a pair of vertically aligned outer posts having hollow interiors and a short inner post segment inserted within the hollow interiors of the outer posts and affixed to both outer posts. Preferably the outer posts are in end to end contact. The inner posts need only be long enough to enable each pair of adjacent outer posts to be adequately secured to each other.

In a further embodiment, the post in post structure also comprises a tray having at least one opening therein, wherein an inner post segment is inserted partway through the opening and two outer support posts are attached to either end of the inner post segment.

The invention is particularly suitable for use with the post in post packaging and display system described in pending U.S. patent application Ser. No. 10/605,814. That system comprises vertically spaced apart trays, inner posts inserted through openings in the trays, and hollow outer posts slipped over the inner posts. The posts space the trays apart and lock them together in vertical alignment.

THE DRAWINGS

DETAILED DESCRIPTION OF THE INVENTION

Figure 1:
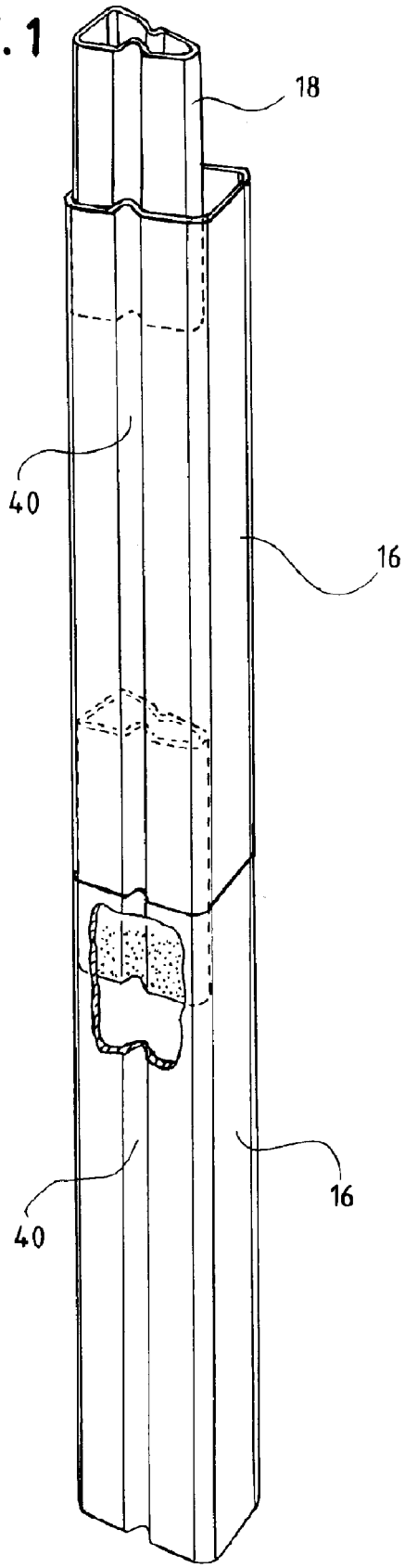
FIG. 1 is a perspective view of the post in post structure of the present invention.
Figure 2:
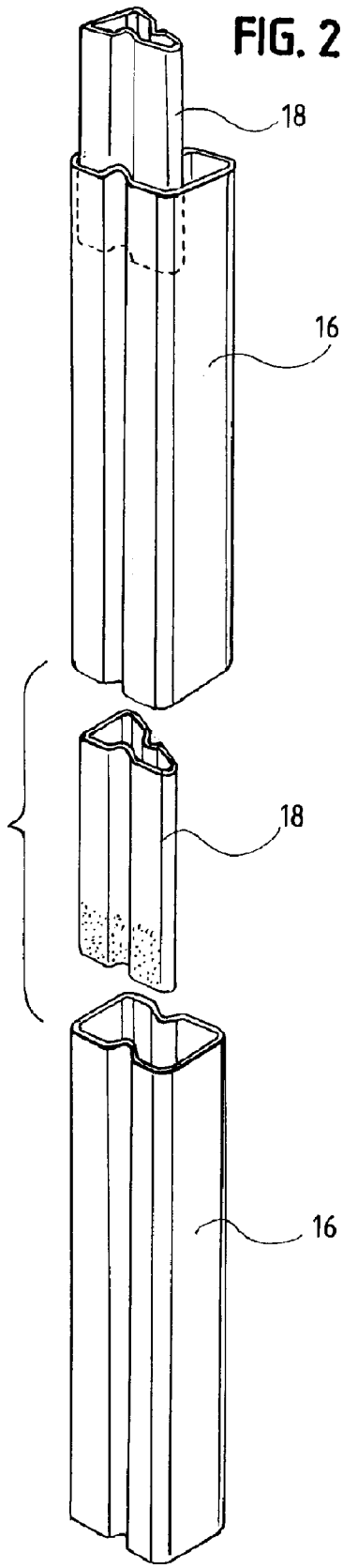
FIG. 2 is an exploded view of the post in post structure of FIG. 1.
Figure 9:
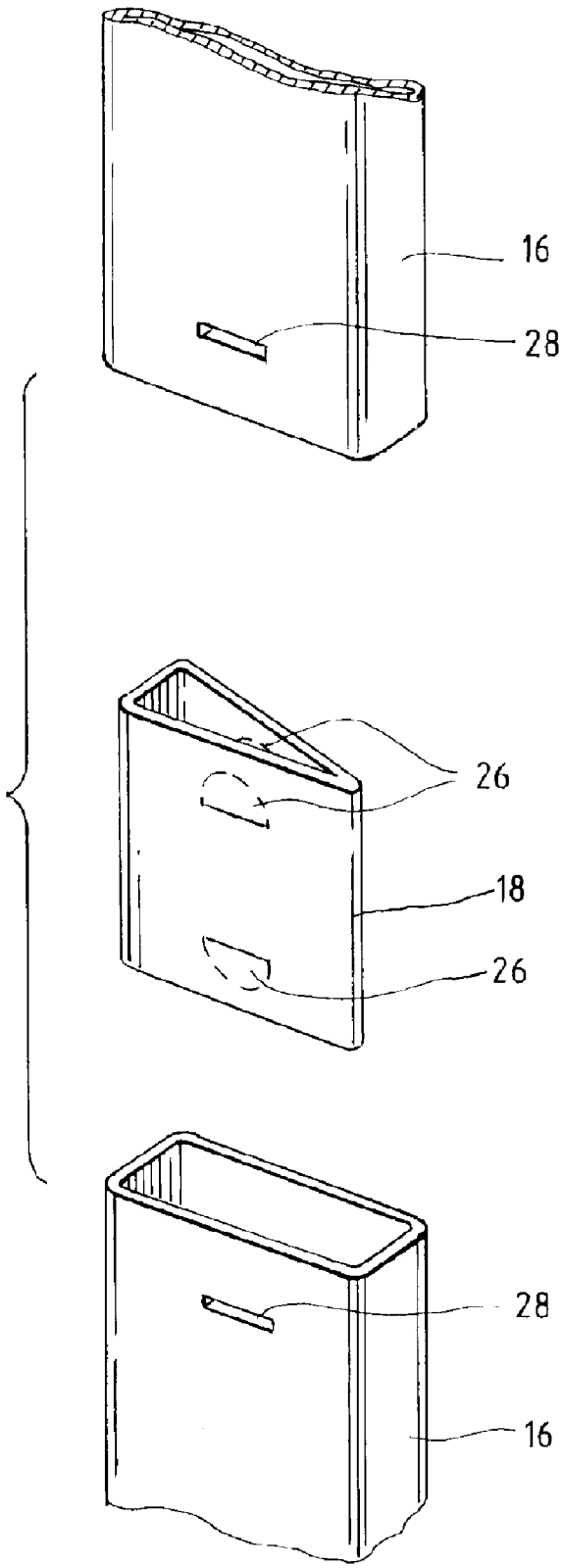
FIG. 9 is an exploded view of an alternative embodiment of a post in post structure according to the invention.

As shown in FIGS. 1 and 2, the present invention is a post in post structure comprising a pair of vertically aligned outer posts 16 having hollow interiors and a short inner post segment 18 inserted within the hollow interiors of the outer posts 16, the inner post segment 18 being affixed both outer posts 16. The inner post segment 18 may be affixed to the outer posts 16 by glue, adhesive, staples, friction fit or any other suitable means. The posts may also be connected by mechanical means. For example, as shown in FIG. 9, D-shaped tabs 26 formed in the inner post segment 18 can be inserted into slots 28 formed in the outer posts 16 to connect the posts together. Preferably the outer posts 16 are in end to end contact.

In a further embodiment, the structure also comprises at least one tray 12 having at least one opening 24 in the bottom 36 of the tray 12, wherein one of the outer posts 16 is aligned over the opening 24 and the other outer post 16 is aligned under the opening 24 such that their hollow interiors communicate with the opening 24. The inner post segment 18 is inserted inside the outer posts 16 and through the tray opening 24 and is affixed to the outer posts 18 as before.

Figure 3:
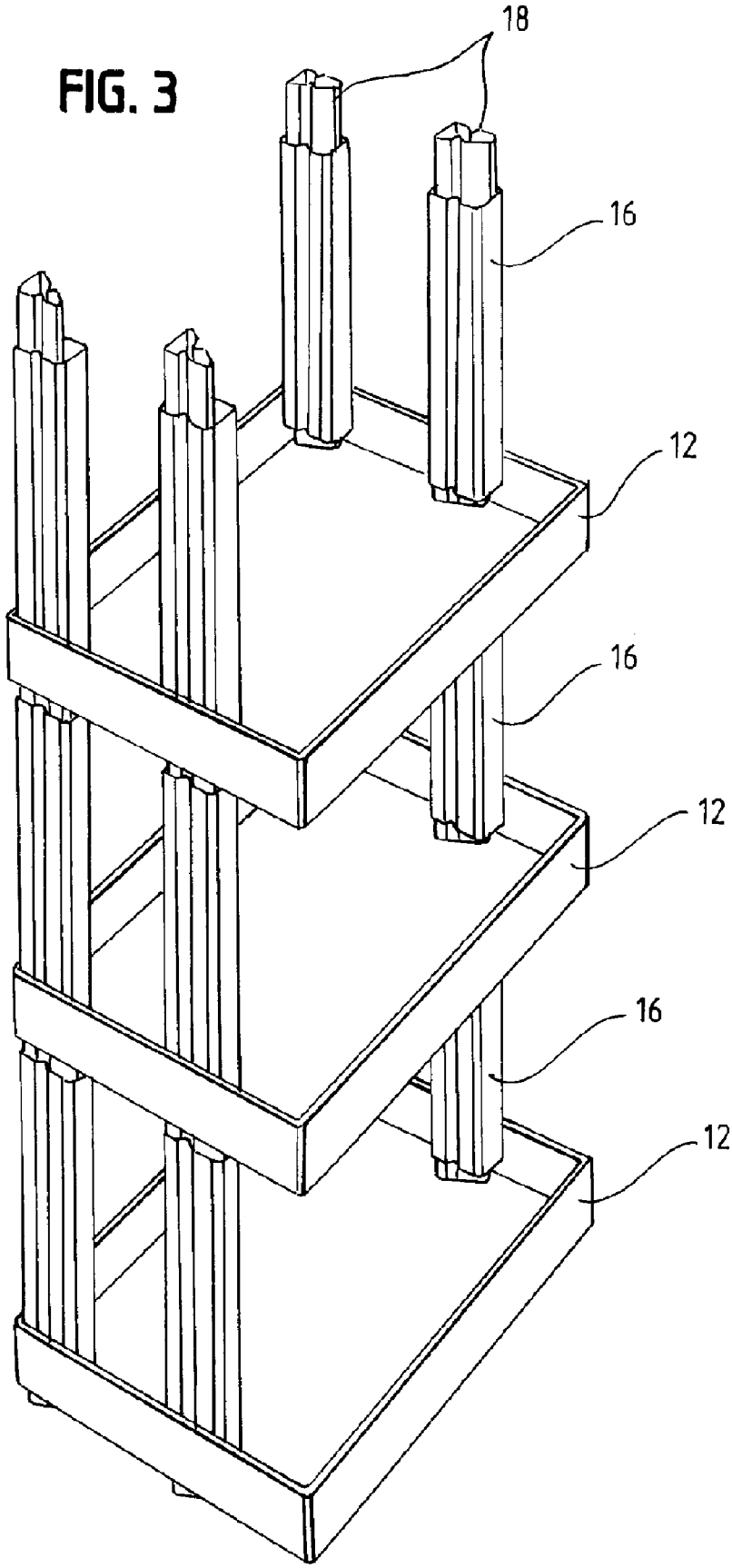
FIG. 3 is a perspective view of a packaging and display assembly incorporating the post in post structure of FIG. 1.
Figure 4:
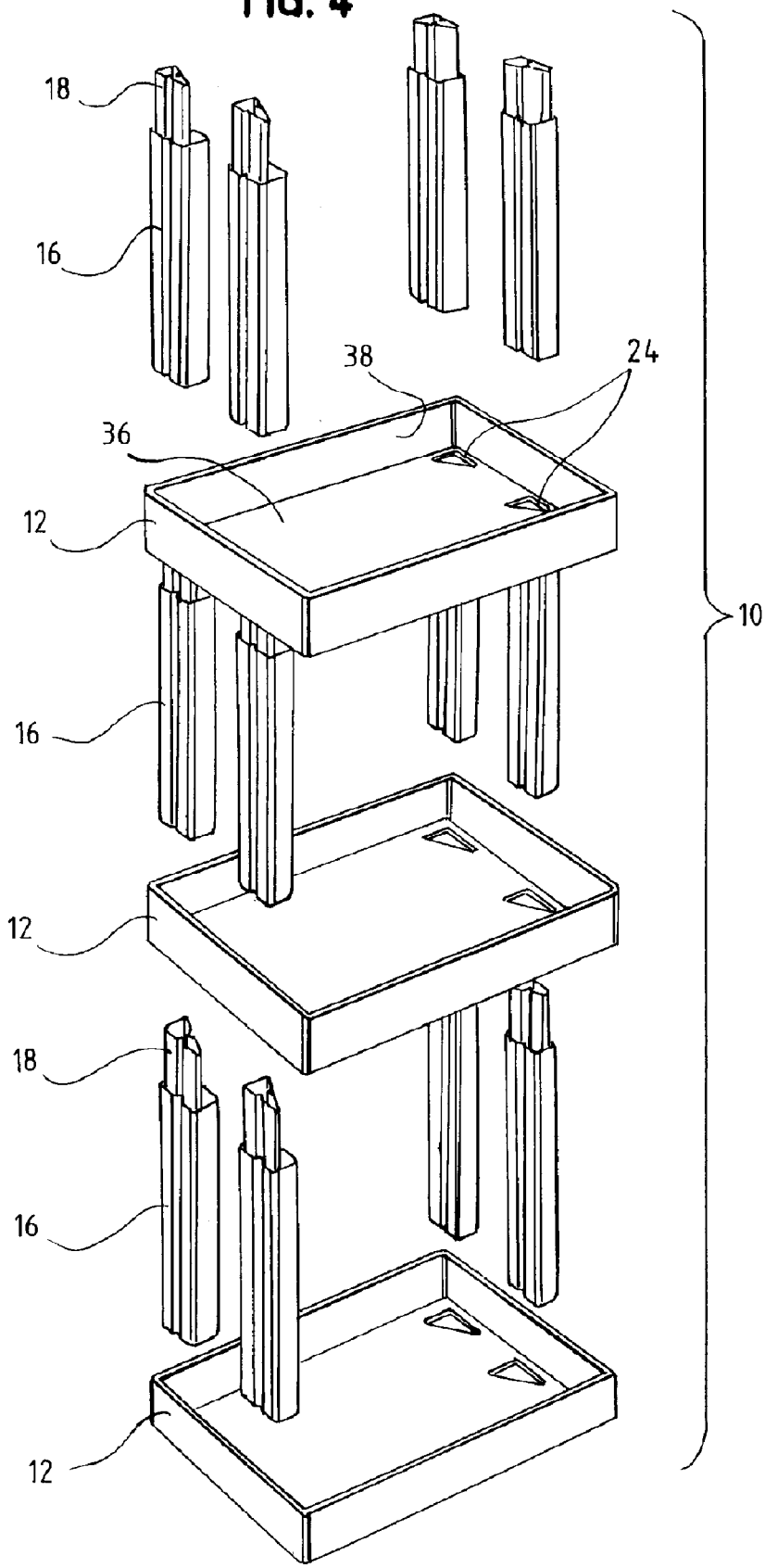
FIG. 4 is an exploded view of the packaging and display assembly FIG. 3.
Figure 5:
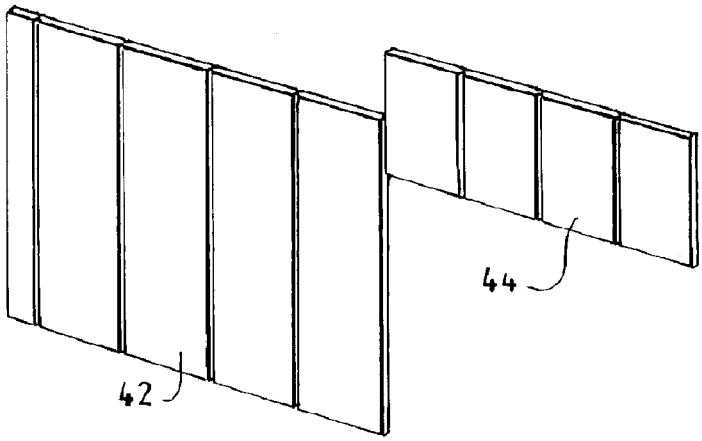
FIG. 5 is a perspective view of two corrugated blanks used to make a corrugated inner post segment and a corrugated outer post.
Figure 6:
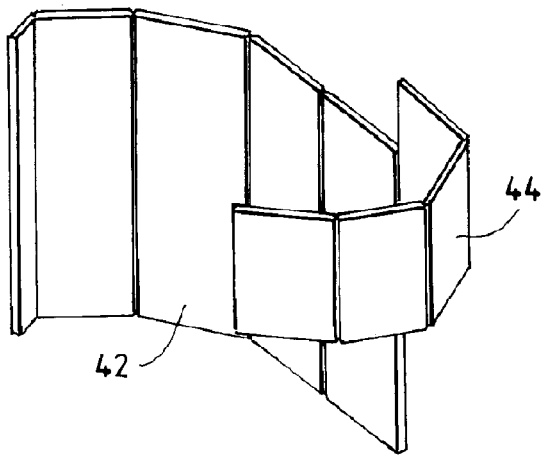
FIG. 6 is a perspective view of the corrugated blanks of FIG. 5 shown partially assembled.
Figure 7:
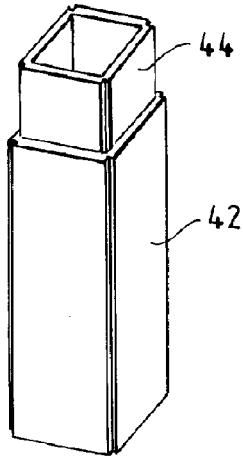
FIG. 7 is a perspective view of a corrugated inner post segment and a corrugated outer post.
Figure 8:
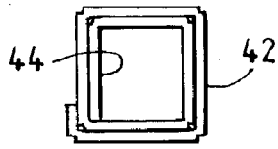
FIG. 8 is a top view of a corrugated inner post segment and a corrugated outer post.

The invention is particularly suitable for use with the post in post packaging, shipping and display assembly described in pending U.S. patent application Ser. No. 10/605,814 and incorporated herein by reference. As shown in FIGS. 3 and 4, the packaging and display assembly 10 comprises vertically spaced trays 12 for holding products (e.g. snack food containers), hollow outer posts 16 arranged over openings 24 die-cut into the bottom 36 of each product tray 12, and inner post segments 18 keyed (inserted) inside the outer posts 16 and through the tray openings 24 to lock the system together. The outer posts 16 provide a platform for each tray 12 and evenly space the trays 12 apart.

Unlike the post in post system described in U.S. patent application Ser. No. 10/605,814, the inner post segments 18 are not at least as long as the outer posts 16 and they are not placed end to end. Rather, the inner post segments 18 are substantially shorter than the outer posts 18 and they are spaced apart. The inner posts segments 18 need only be long enough to enable each pair of adjacent outer posts 16 to be adequately secured to each other.

The product trays 12 preferably are formed from corrugated board, although any suitable material may be used. Each tray 12 comprises a bottom panel 36 and short sidewalls 38 extending upward from the periphery of the bottom panel 36. The bottom panel 36 and/or side panels 38 may be printed or otherwise decorated in any desirable fashion to increase the aesthetic appeal of the display.

The bottom panel 36 has die-cut openings 24 disposed in void spaces around the product containers 14. These openings 24 are large enough to accommodate the inner post segments 18 but smaller than the outer posts 16 or at least configured such that the outer posts 16 cannot fit within the openings 24. The number of openings 24 required in each tray 12 is a function of the number of post columns. As shown in FIGS. 3 and 4, a typical assembly 10 will have four columns of posts and thus four openings 24 in each tray 12. The die-cut openings 24 may be arranged on the trays 12 in any suitable fashion, although it is preferred that there be an opening 24 near each corner of the trays 12.

The height of the outer posts 16 is determined by the height of the product containers or, more particularly, the desired spacing between trays 12. The outer posts 16 may be attached to the trays 12 in some fashion or simply held in place by the inner post segments 18.

Preferably, the outer posts 16 are hollow paper tubes formed into a desired shape, such as those manufactured by Sonoco Products Company of Hartsville, S.C. and described in U.S. Pat. Nos. 4,482,054; 5,593,039; 6,059,104 and 6,186,329, incorporated herein by reference. In the embodiment illustrated in the figures, the outer posts 16 have a substantially rectangular cross-sectional profile with beads or grooves 40 running longitudinally along two opposing walls, although any suitable cross-sectional shape may be used, including but not limited to circular and triangular. Since the outer posts 16 are visible to the consumer, they too may be printed or otherwise decorated in any desirable fashion to increase the aesthetic appeal of the display.

The inner post segments 18 must be small enough in cross-section to be inserted through the openings 24 in the trays 12 and inside the ends of the outer posts 16. Like the outer posts 16, the inner post segments 18 may be wound paper tubes such as those manufactured by Sonoco Products Company. The inner post segments 18 may have any suitable cross-sectional shape, including but not limited to triangular, and should fit snugly inside the outer posts 16.

Thus there has been described a post in post structure for use in the packaging, shipping and displaying of products. The structure features a pair of outer posts 16 connected together by a short inner post segment 18. The inner post segment 18 is affixed to the outer posts 18 and need only be long enough to enable the outer posts 18 to be adequately secured to each other.

In one alternative embodiment of the invention, the outer posts and inner post segments are made from folded corrugated rather than wound paper tubes. As shown in FIGS. 5–8, each post is formed from a corrugated blank 42, 44 that is folded into a cylinder having a polygonal cross section. The corrugated inner post segments 44 are sized to fit snugly within the corrugated outer posts 42 and, as in the preferred embodiment, need only be long enough to secure two outer posts 42 placed end to end.

Other modifications and alternative embodiments of the invention are contemplated that do not depart from the scope of the invention as defined by the foregoing teachings and appended claims. It is intended that the claims cover all such modifications that fall within their scope.

What is claimed is:

1. In an improved system for packaging, shipping and displaying products, the system comprising a plurality of vertically spaced trays for holding the products, inner posts inserted through openings in each tray such that portions of each inner post extend above and below each tray, and a pair of outer posts slipped over either end of each inner post, the improvement comprising:

each inner post being shorter than the outer posts and affixed to the pair of outer posts.

2. The system of claim 1 wherein each inner post is affixed to the pair of outer posts by a friction fit.

3. The system of claim 1 wherein each inner post is affixed to the pair of outer posts by adhesive.

4. The system of claim 1 wherein each inner post is affixed to the pair of outer posts by staples.

5. The system of claim 1 wherein each inner post comprises die cut tab portions that insert into slots disposed in the outer post.

6. The system of claim 1 wherein each inner post and the outer posts are formed from wound paper.

7. The system of claim 1 wherein each inner post and the outer posts are formed from folded corrugated.

* * * * *